US008371482B2

(12) United States Patent
Rueschhoff et al.

(10) Patent No.: US 8,371,482 B2
(45) Date of Patent: Feb. 12, 2013

(54) ACTUATION LEVER OF AN AEROSOL VALVE

(75) Inventors: Kenneth J. Rueschhoff, Wildwood, MO (US); James P. McBroom, House Springs, MO (US); David G. Sharpe, Hawkpoint, MO (US)

(73) Assignee: Clayton Corporation, Fenton, MO (US)

( * ) Notice: Subject to any disclaimer, the term of this patent is extended or adjusted under 35 U.S.C. 154(b) by 316 days.

(21) Appl. No.: 12/892,621

(22) Filed: Sep. 28, 2010

(65) Prior Publication Data

US 2011/0073621 A1 Mar. 31, 2011

Related U.S. Application Data

(60) Provisional application No. 61/246,379, filed on Sep. 28, 2009.

(51) Int. Cl.
*B65D 83/00* (2006.01)

(52) U.S. Cl. ..... 222/402.15; 222/402.21

(58) Field of Classification Search ..... 220/284; 222/192, 402.13, 402.14, 402.15, 402.21, 222/538

See application file for complete search history.

(56) References Cited

U.S. PATENT DOCUMENTS

| | | | | | |
|---|---|---|---|---|---|
| 3,066,838 | A | * | 12/1962 | Hansen | 222/402.13 |
| 3,611,820 | A | * | 10/1971 | Hempel | 74/102 |
| D265,047 | S | * | 6/1982 | Reel | D8/18 |
| D301,196 | S | * | 5/1989 | Price | D8/18 |
| 5,992,707 | A | * | 11/1999 | Gaichuk | 222/402.13 |
| 6,299,032 | B1 | * | 10/2001 | Hamilton | 222/402.15 |
| 6,637,627 | B1 | * | 10/2003 | Liljeqvist et al. | 222/402.15 |
| 6,874,663 | B2 | * | 4/2005 | Scheindel | 222/402.15 |
| 2004/0256418 | A1 | * | 12/2004 | Scheindel | 222/402.15 |
| 2005/0011914 | A1 | * | 1/2005 | Frutin | 222/402.15 |
| 2005/0045664 | A1 | * | 3/2005 | Taylor | 222/402.15 |
| 2010/0025437 | A1 | * | 2/2010 | Oshimo et al. | 222/402.13 |
| 2011/0079617 | A1 | * | 4/2011 | Quarles et al. | 222/402.15 |

FOREIGN PATENT DOCUMENTS

GB 2297586 A * 8/1996

* cited by examiner

*Primary Examiner* — Kevin P Shaver
*Assistant Examiner* — Patrick M Buechner
(74) *Attorney, Agent, or Firm* — Harness, Dickey & Pierce, P.L.C.

(57) ABSTRACT

A lever of an aerosol valve having a valve stem includes a lever member having first and second end portions, a first aperture disposed in the first end portion, and a second aperture disposed between the first and second end portions. The first aperture is configured to permit the lever member to be releasably received over a valve stem of an aerosol valve in a dispensing position, in which the second end portion extends outwardly from the valve stem to provide for pivotally displacing the valve stem to dispense product therethrough. The second aperture is configured so that the lever member fits in a stored position with the second aperture around a portion of the valve stem, and the first and second end portions extending alongside the valve stem, such that the lever member may be stored under a cover.

20 Claims, 6 Drawing Sheets

ACTUATION LEVER OF AN AEROSOL VALVE

CROSS-REFERENCE TO RELATED APPLICATION

This application claims the benefit of U.S. Provisional Application No. 61/246,379, filed on Sep. 28, 2009. The entire disclosure of the above application is incorporated herein by reference.

FIELD

The present disclosure relates to valves for aerosol containers, and more specifically to actuation of valves for aerosol containers.

BACKGROUND

This section provides background information related to the present disclosure which is not necessarily prior art.

The present application relates to aerosol valve products, and more specifically to aerosol containers with valve stems for dispensing product.

SUMMARY

This section provides a general summary of the disclosure, and is not a comprehensive disclosure of its full scope or all of its features.

A lever of an aerosol valve having a valve stem includes a lever member having first and second end portions, a first aperture disposed in the first end portion, and a second aperture disposed between the first and second end portions. The first aperture is configured to permit the lever member to be releaseably received over a valve stem of an aerosol valve in a dispensing position, in which the second end portion extends outwardly from the valve stem to provide for pivotally displacing the valve stem to dispense product therethrough. The second aperture is configured so that the lever member fits in a stored position with the second aperture around the valve stem, with the first and second end portions extending alongside the valve stem. Accordingly, the lever member may be stored under a cover secured over the valve stem.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

In the various exemplary embodiments, a lever is provided that is configured to be stored within the interior space of a cover that is adapted to be secured over an aerosol container. The lever is configured to be positioned over a valve stem of an aerosol container in either a dispensing position during use, or in a stowed position in which the lever fits within the interior space of the cover when the cover is secured to the aerosol container. Further aspects of the various embodiments will be understood from the following description.

Figure 1:
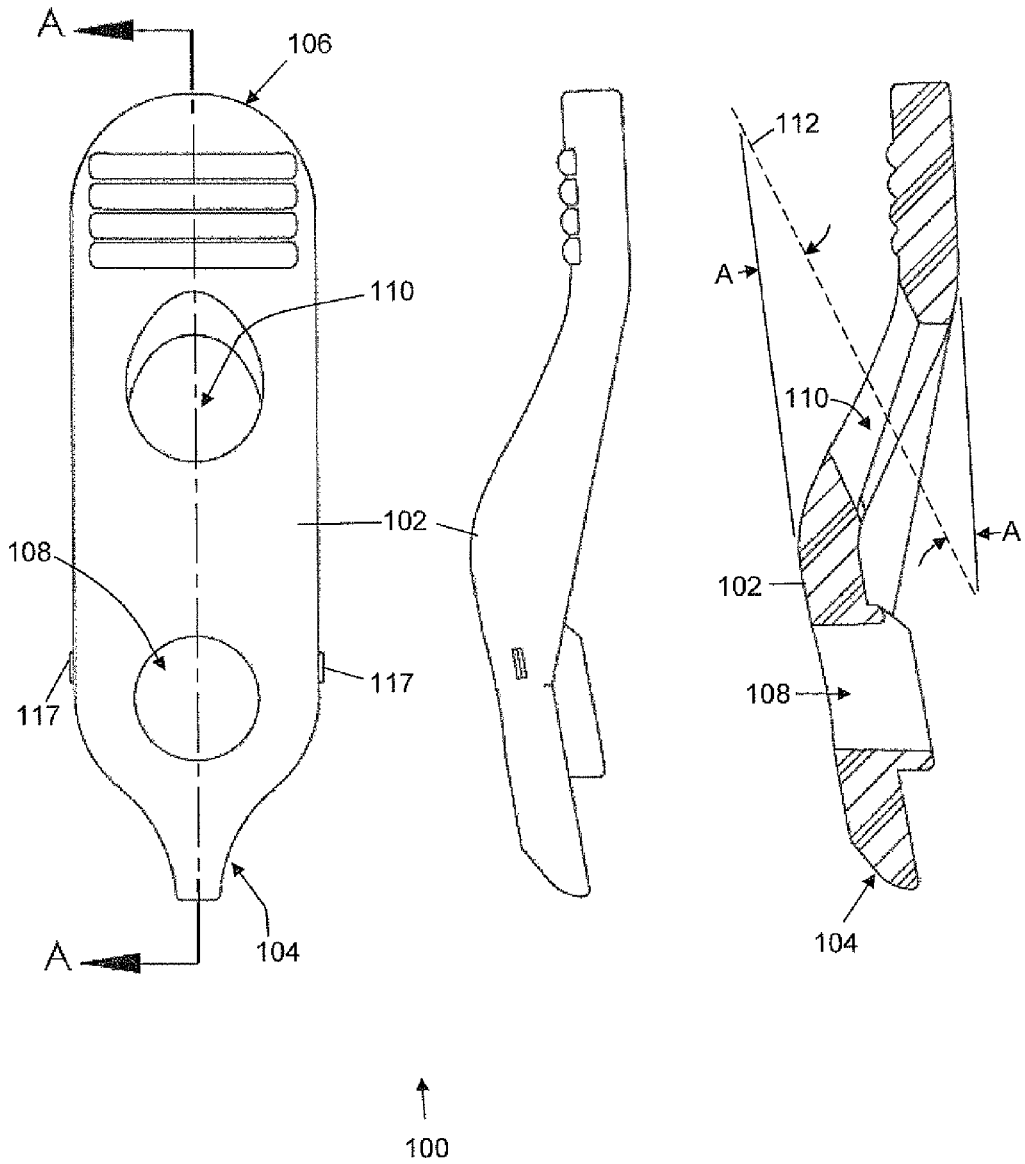
FIG. 1 is a first embodiment of a lever member, in accordance with the present application.
Figure 2:
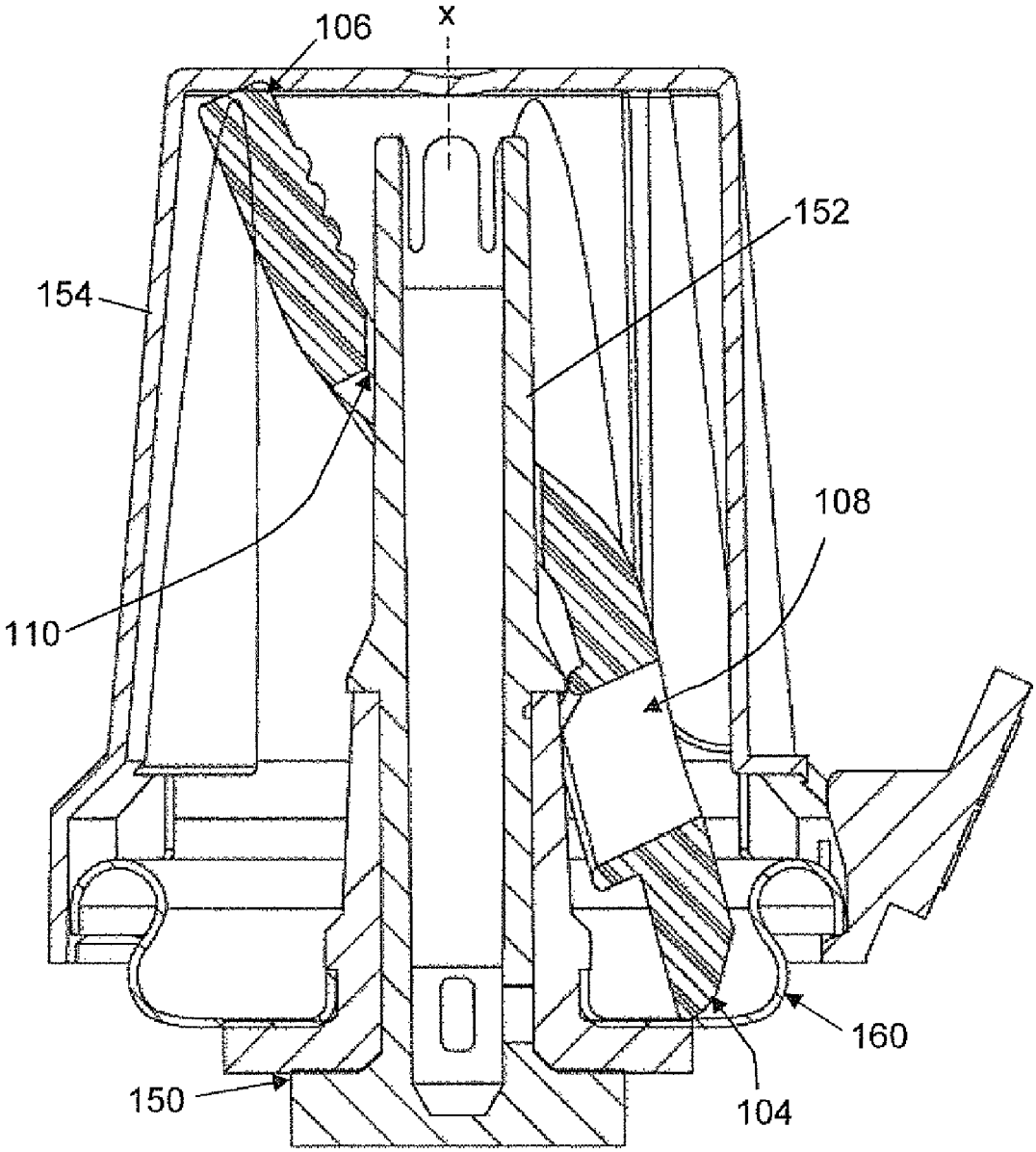
FIG. 2 is a cross-sectional view of the lever member of FIG. 1 positioned to be stored over a valve stem of an aerosol container, in accordance with the present application.
Figure 3A:
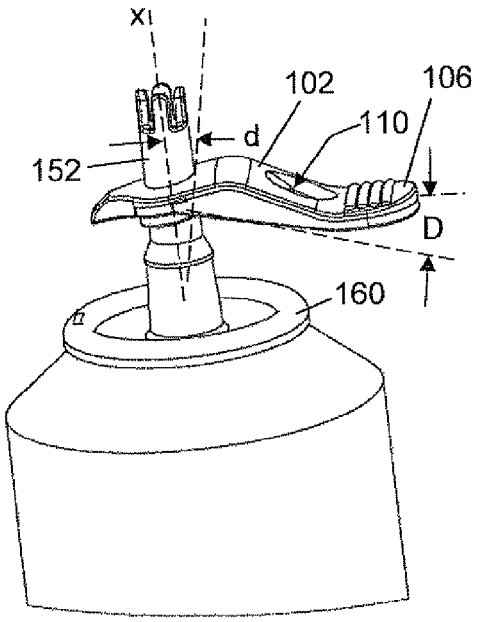
FIGS. 3A and 3B are side elevation views of the top portion of an aerosol container having a valve stem with the lever member of FIG. 1 shown in both a dispensing and stored position, respectively.

In one aspect of the present disclosure, a first embodiment of a lever 100 is provided as shown in FIG. 1. The lever 100 comprises a lever member 102 having first and second end portions 104, 106, a first aperture 108 disposed in the first end portion 104, and a second aperture 110 disposed between the first and second end portions 104, 106. The first aperture 108 is configured to permit the lever member 102 to be releasably received over a valve stem 152 of an aerosol valve 150 in a dispensing position as shown in FIG. 3A, in which the second end portion 106 extends outwardly from the valve stem 152 to provide for pivotally displacing the valve stem 152 to dispense product therethrough. The second aperture 110 is configured so that the lever member 102 fits in a stored position with the second aperture 110 around a portion of the valve stem 152 and the first and second end portions 104, 106 extending generally alongside the valve stem 152, such that the lever member 102 may be stored under a cover 154 secured over the valve stem 152 as shown in FIG. 2.

Referring to FIG. 1, the second aperture 110 may be angled relative to the first end portion 104, such that the lever member 102 fits in a stored position around the valve stem 152, and the first and second end portions 104, 106 extend at an angle of between 0 to 20 degrees relative to the axis "x" of the valve stem 152. For example, the axis 112 of the second aperture 110 in which the valve stem 152 may be received is at an angle A of about 0 to 20 degrees relative to the first and second end portions 104, 106.

Figure 5:
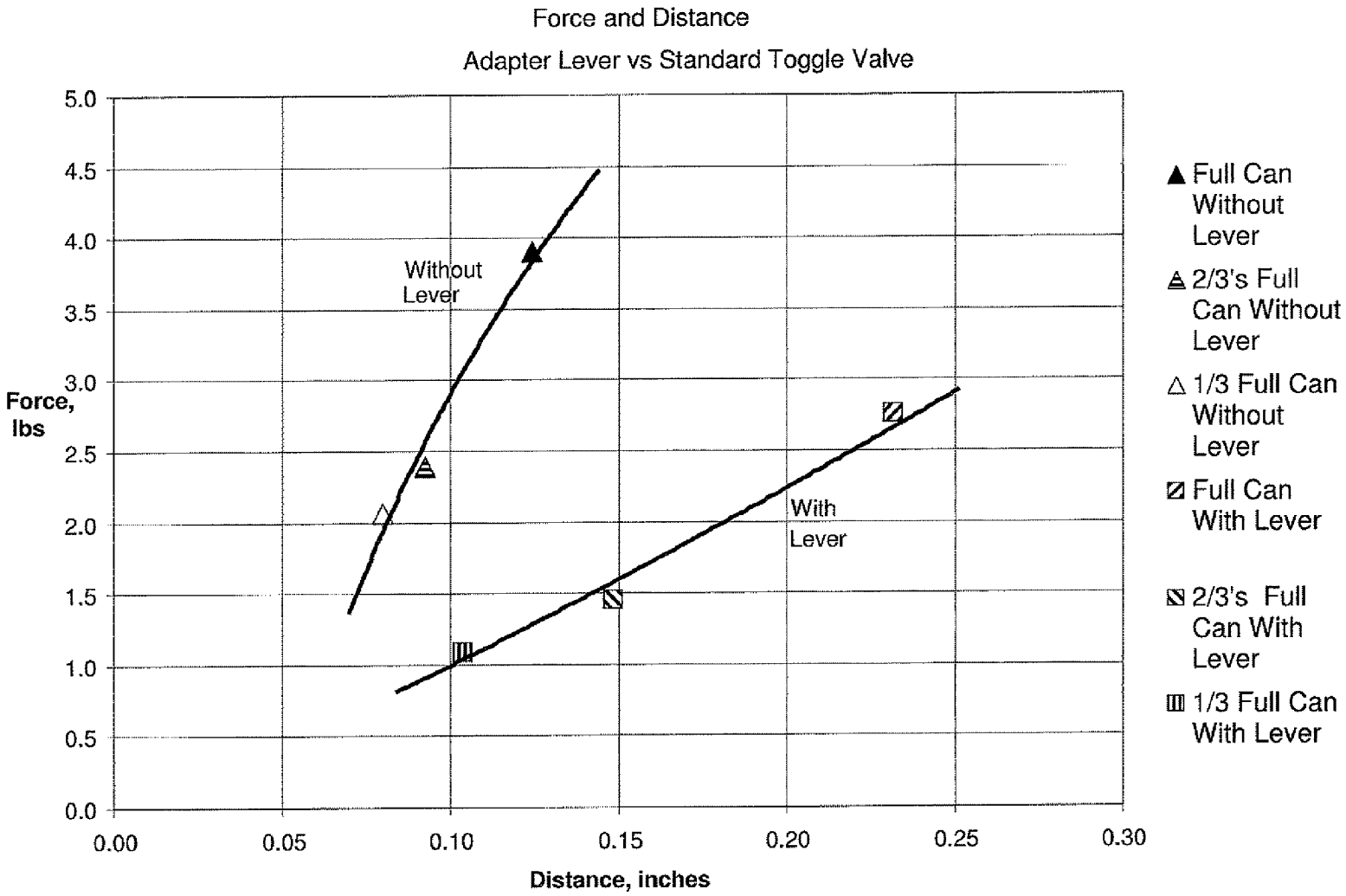
FIG. 5 is a graph comparing the load force required for deflecting a valve stem of a conventional aerosol valve with the load force required for displacing the lever member in the dispensing position.

The first aperture 108 in the lever member 102 is configured to be releasably received over a valve stem 152 of an aerosol valve 150 as shown in FIG. 3A, such that the second end portion 106 extending outwardly from the valve stem 152 provides a lever displacement range (the distance "D" that the second end portion 106 may be displaced) that is greater than the displacement range "d" of the valve stem 152 (the distance the tip of the valve stem 152 is displaced from its normally vertical orientation shown by axis x). As shown in Tables 1 and 2 below, sample valves had valve stems that were deflected under maximum load to an average displacement range of 0.124 inches, while samples with the present trigger lever 100 were deflected under maximum load to an average displacement of 0.232 inches. Thus, the lever member 102 is configured to be releasably received over a valve stem 152 of an aerosol valve 150, such that the second end portion 106 extending outwardly from the valve stem 152 provides a lever displacement range "D" that is at least 87% greater than the displacement range of deflection "d" of the valve stem 152, which provides increased control over the rate of dispensing a product such as processed cheese. As shown in Tables 1 and 2 below, an average load force of 1.086 pounds was required to displace the second end portion 106 of the trigger lever 100 for deflecting the valve stems 152 a ⅓ of its deflection range to initiate dispensing operation, which is significantly less than the 2.065 average load force applied directly to the valve stems for deflecting the valve stems to a ⅓ of its deflection range. Thus, the lever member 102 is configured to reduce the force required to initiate operation by 47 percent less. In one embodiment of a lever member 102, the lever member 102 was found to possess a mechanical advantage that provided the following ranges of applied forces and displacement strokes shown in Tables 1 and 2 below, and in the Graph shown in FIG. 5.

TABLE 1

Actuation Of Valve/Stem With No Trigger Lever - Dispensing Of Cheese

| | A Full | | B ⅔ | | C ⅓ | |
|---|---|---|---|---|---|---|
| Can | Maximum Load (lbf) | Deflection at Maximum Load (in) | Maximum Load (lbf) | Deflection at Maximum Load (in) | Maximum Load (lbf) | Deflection at Maximum Load (in) |
| 1 | 3.782 | 0.134 | 2.415 | 0.098 | 1.952 | 0.090 |
| 2 | 4.037 | 0.130 | 2.416 | 0.096 | 2.383 | 0.082 |
| 3 | 3.893 | 0.109 | 2.343 | 0.084 | 1.860 | 0.068 |
| Min | 3.782 | 0.109 | 2.343 | 0.084 | 1.86 | 0.068 |
| Max | 4.037 | 0.134 | 2.416 | 0.098 | 2.383 | 0.090 |
| Average | 3.904 | 0.124 | 2.391 | 0.093 | 2.065 | 0.080 |

TABLE 2

Actuation Of Valve/Stem With A Trigger Lever - Dispensing Of Cheese

| | B Full | | C ⅔ | | D ⅓ | |
|---|---|---|---|---|---|---|
| Can | Maximum Load (lbf) | Deflection at Maximum Load (in) | Maximum Load (lbf) | Deflection at Maximum Load (in) | Maximum Load (lbf) | Deflection at Maximum Load (in) |
| 5 | 3.017 | 0.264 | 1.305 | 0.132 | 1.106 | 0.118 |
| 6 | 2.700 | 0.215 | 1.399 | 0.135 | 1.026 | 0.074 |
| 7 | 2.556 | 0.216 | 1.646 | 0.178 | 1.127 | 0.119 |
| Min | 2.556 | 0.215 | 1.305 | 0.132 | 1.026 | 0.074 |
| Max | 3.017 | 0.264 | 1.646 | 0.178 | 1.127 | 0.119 |
| Average | 2.758 | 0.232 | 1.450 | 0.148 | 1.086 | 0.104 |

In the first embodiment of a lever 100, the lever member 102 preferably has a length sufficient to provide a mechanical advantage that is effective to reduce the force required to initiate dispensing operation. The lever member 102 preferably comprises a length from the center "C" of the first aperture 108 to the second end portion 106 of at least 1.125 inches. For example, the lever member 102 of the first embodiment has a length of between about 1.50 to about 1.75 inches.

The first aperture 108 in the lever member 102 allows for assembling the lever member 102 over the valve stem 152 to provide for changing the conventional direction of toggle force applied perpendicular to the valve stem to a downward direction generally 90 degrees from what is currently used on some items (i.e. aerosol cheese valve where force is normally applied against the tip portion of a valve stem). This downward force direction is both easier for the average user and more controllable in a pulling motion as compared to a generally pushing motion. Thus, in addition to the length of the lever member 102 that provides a lever stroke/range "D" that is greater than the valve stem stroke/range "d" (which improves control over the flow rate of product being dispensed), the lever 100 permits application of a downward force that is both easier for the average user and more controllable. The present lever member 102 can be located or positioned with the lever member 102 on the valve stem 152 such that the user can simultaneously hold an aerosol can 160 and ergonomically press the second end portion 106 of the lever member 102.

The portion of the lever member 102 in which the second aperture 110 is disposed has a reduced cross-sectional area relative to the cross-sectional area of the second end portion 106 of the lever member 102. This reduced cross-sectional area may increase deflection in the lever member 102 when the second end portion 106 is depressed. Thus, in addition to the length of the lever member 102 that provides a lever stroke/range "D" that is greater than the valve stem stroke/range "d" (which improves control over the flow rate of product being dispensed), depressing the second end portion 106 of the lever member 102 also causes deflection in the lever member 102 that further increases the lever stroke, to provide for even greater control.

Figure 4:
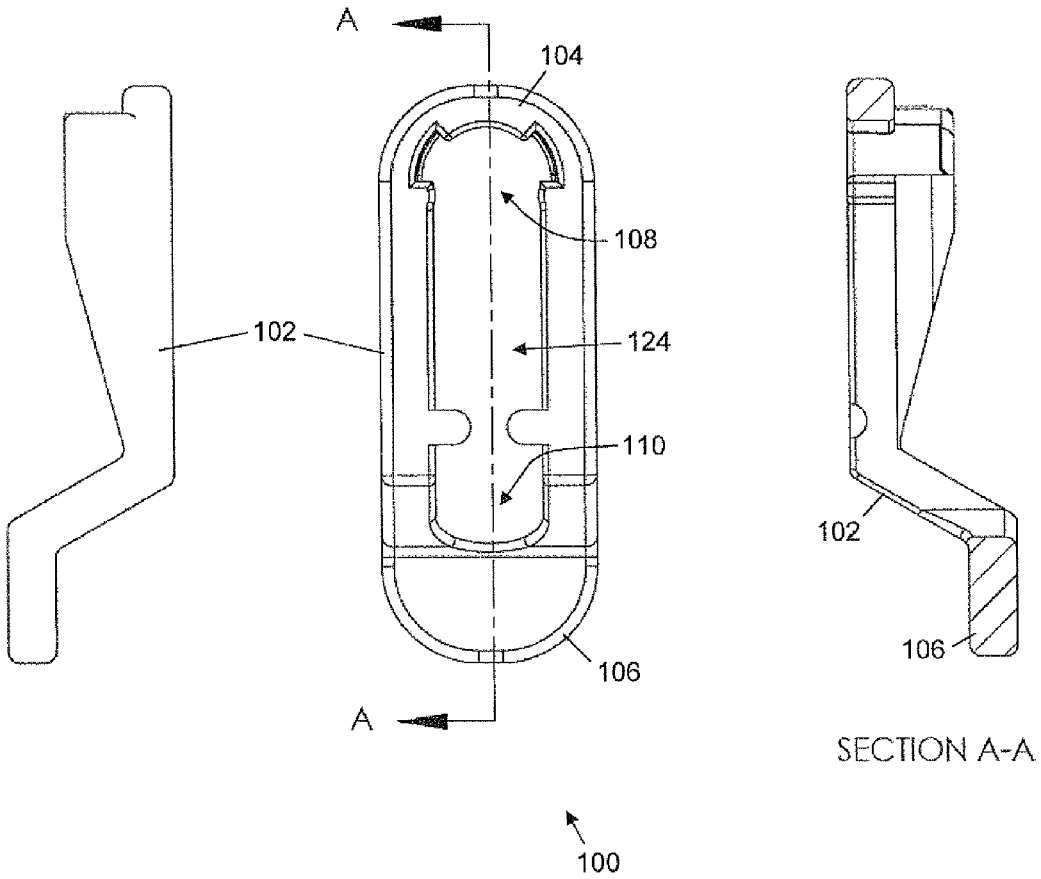
FIG. 4 is an alternate construction of a lever member in accordance with the present application.

In an alternate construction of the lever 100, the lever member 102 may further include a slot 124 extending between the first and second apertures 108 and 110, such that the lever member 102 may be slid from the stored position (with the second aperture 110 around the valve stem 152) to the dispensing position (with the first aperture 108 around the valve stem 152), without removing the lever member 102 from the valve stem 152. For example, the lever member 102 may have a slot 124 as shown in FIG. 4.

In the first embodiment described above, the lever member 102 is configured to be releasably received over a valve stem 152 of an aerosol valve 150, such that the second end portion 106 extending outwardly from the valve stem 152 may be depressed instead of the valve stem 152. This enables the user to press the lever member 102 instead of the valve stem 152, which reduces risk of contact with and contamination of food product dispensed from the valve stem 152.

In another aspect of the present disclosure, an embodiment of a lever 100 in combination with a cover 154 is disclosed, in which the lever 100 is configured to be stored over a valve stem 152 of an aerosol container 160 as shown in FIG. 2, within the interior space of a cover 154 that is adapted to be secured over the valve stem 152 of an aerosol container 160. The combination includes a cover 154 configured to be secured over a valve stem 152 of an aerosol container 160, and a lever member 102 configured to be stored within the interior space of the cover 154. The cover 154 is preferably a standard cover diameter configured to be secured over a 1 inch aerosol container 160. The open end of the standard cover diameter has a diameter of about 1.30 inches, and the cover 154 has an overall height of about 1.50 inches.

Figure 3B:
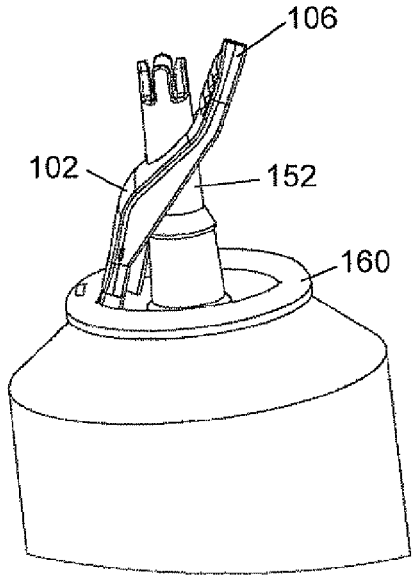

The lever member 102 has first and second end portions 104, 106, a first aperture 108 disposed in the first end portion 104, and a second aperture 110 disposed between the first and second end portions 104, 106. The first aperture 108 is configured to permit the lever member 102 to be releasably received over a valve stem 152 of an aerosol valve 160 in a dispensing position, as described above and shown in FIG. 3A. The second aperture 110 is configured so that the lever member 102 fits in a stored position as shown in FIG. 3B, with the second aperture 110 around a portion of the valve stem 152 and the first and second end portions 104, 106 extending generally alongside the valve stem 152. The second aperture 110 is preferably angled relative to the first end portion 104, such that the lever member 102 fits in a stored position with the first and second end portions 104, 106 alongside the valve stem 152, being at an angle of between 0 to 20 degrees relative to the axis "x" of the valve stern 152.

Accordingly, the present embodiments are distinguished over conventional valves by the retainment of the lever member 102 within the interior of the cover 154, which is very useful to manufacturing and filling operations in providing a trigger or lever 100 with the final package without modifying current high cost filling line equipment or additional production space. The lever member 102 also may be advantageously positioned over the valve stem 152 such that the user can simultaneously hold the aerosol can 160 and ergonomically press the second end portion 106 of the lever member 102 in a downward force direction that is both easier for the average user and more controllable as compared to a generally pushing motion applied perpendicularly against the tip of the valve stem 152. By positioning the lever member 102 over the valve stem 152, the above embodiments provide another advantage in moving the point at which the user's finger applies a force, from a point near the tip of the valve stem 152 where contamination may likely occur, to the second end portion 106 of the lever member 102, which is further removed from the tip of the valve stem 152. Thus, the lever member 102 also reduces the risk of product contamination during dispensing operation.

Figure 6:
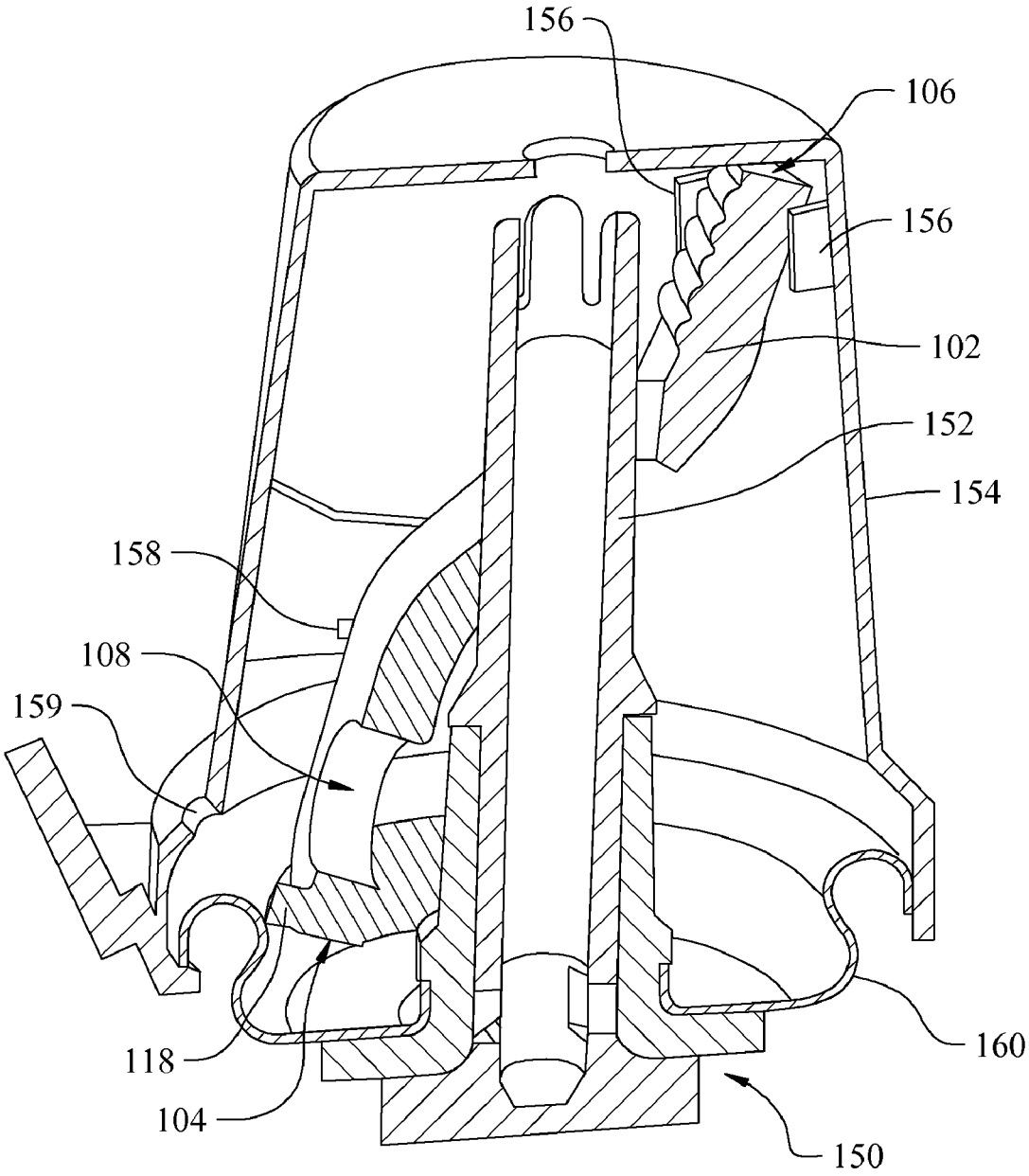
FIG. 6 is a cutaway view of an embodiment of a lever and cover.

In another aspect of the present disclosure, another embodiment of a lever 100 and cover 154 in combination are described and shown in FIGS. 1 and 6. The combination includes a cover 154 configured to be secured over a valve stem 152 of an aerosol container 160 as in the previously described embodiments. Referring to FIG. 6, the cover 154 has a pair of guide ribs 156 disposed within the interior of the cover 154, in between which the second end portion 106 of the lever member 102 is located. The lever has at least one retaining member 117 or 118 that is configured to be received within an opening or recess in the cover 154, to retain the lever member 102 within the cover 154. As shown in FIG. 2, the lever member 102 has two points 117 on the sides of the lever that project outwardly, which as shown in FIG. 6 are configured to frictionally slide along an interior wall and into a recess 158 within the cover 154. The lever member 102 has a protrusion or projecting member 118, which is configured to be received within an opening 159 in the side wall of the cover 154, where the protrusion 118 fits within the opening 159 to provide an interference fit for retaining the lever member 102 within the interior of the cover 154. Accordingly, the lever member 102 includes at least one protrusion or retaining member that is configured to be received within an opening or recess in the cover 154, to releasably retain the lever member 102 within the interior of the cover 154. The lever member 102 has first and second end portions 104, 106, a first aperture 108 disposed in the first end portion 104, and a second aperture 110 disposed between the first and second end portions 104, 106. The first aperture 108 is configured to permit the lever member 102 to be releasably received over a valve stem 152 of an aerosol valve 160 in a dispensing position. The second aperture 110 is configured so that the lever member 102 fits in a stored position with the second aperture 110 around a portion of the valve stem 152 and the first and second end portions 104, 106 extending generally alongside the valve stem 152. This allows the lever member 102 to be stored under the cover 154 when the cover 154 is secured over a valve stern 152 of an aerosol container 160. In this exemplary embodiment, the projection 118 or the end of the lever member 102 is configured to engage a portion of an aerosol container 160 when the cover 154 (in which the lever member 102 is releasably retained) is secured to the aerosol container 160. The engagement of the projection 118 or the end of the lever member 102 with a portion of the aerosol container 160 causes the projection 118 to dislodge from the opening 159 in the cover 154, such that subsequent removal of the cover 154 from the aerosol container 160 results in the lever member 102 not being retained within the cover 154.

The example embodiments above are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A lever of an aerosol valve having a valve stem, comprising:

a lever member having first and second end portions, a first aperture disposed in the first end portion, and a second aperture disposed between the first and second end portions, the first aperture being configured to permit the lever member to be releasably received over a valve stem of an aerosol valve in a dispensing position, in which the second end portion extends outwardly from the valve stem to provide for pivotally displacing the valve stem to dispense product therethrough, and the second aperture being configured so that the lever member fits in a stored position with the second aperture around a portion of the valve stem and the first and second end portions extending generally alongside the valve stem, such that the lever member may be stored under a cover secured over the valve stem.

2. The lever of claim 1, wherein the second aperture is angled relative to the first end portion such that the lever member fits with the second aperture around the valve stem, with the first and second end portions at an angle of between 0 to 20 degrees relative to the axis of the valve stem.

3. The lever of claim 1, wherein the first aperture of the lever member is configured to be releasably received over a valve stem of an aerosol valve, such that the second end portion extending outwardly from the valve stem provides a lever displacement range that is at least 87 percent greater than the valve stem's displacement range.

4. The lever of claim 3 wherein the first aperture of the lever member is configured to be releasably received over a valve stem of an aerosol valve, such that the force required to displace the second end portion for initiating dispensing operation is at least 47 percent less than the force required to displace the valve stem for initiating dispensing operation.

5. The lever of claim 1, wherein the lever member has a length from the center of the first aperture to the second end portion of at least 1.125 inches, to provide a mechanical advantage sufficient to reduce the force required to initiate dispensing operation by at least 47 percent.

6. The lever of claim 1, wherein the lever member is configured to be releasably received over a valve stem of an aerosol valve, such that the second end portion extending outwardly from the valve stem may be depressed by a user instead of the valve stem, to thereby reduce risk of contact with and contamination of food product dispensed from the valve stem.

7. The lever of claim 1, wherein the portion of the lever member in which the second aperture is disposed has a reduced cross-sectional area relative to the cross-sectional area of the second end portion of the lever.

8. The lever of claim 1, wherein the lever member further includes a slot extending between the first and second apertures, such that the lever member may be slid from the stored position to the dispensing position without removing the lever member from the valve stem.

9. The lever of claim 1, wherein the lever member further includes a retaining member configured to engage a retaining member within a cover to be secured over a valve stem, to thereby releasably retain the lever member within the cover.

10. The lever of claim 9 wherein the lever member further includes a projection thereon that is configured to engage an aerosol container when the cover in which the lever is releasably retained is secured to the aerosol container, which engagement causes the retaining member of the lever to dislodge from the cover such that the lever member is not retained to the cover upon subsequent removal of the cover.

11. A lever in combination with a cover for an aerosol valve having a valve stem, comprising:

a cover configured to be secured over a valve stem of an aerosol container; and a lever member configured to be stored within the interior space of the cover configured to be secured over a valve stem, the lever member having first and second end portions, a first aperture disposed in the first end portion, and a second aperture disposed between the first and second end portions, the first aperture being configured to permit the lever member to be releasably received over a valve stem of an aerosol valve in a dispensing position, and the second aperture being configured so that the lever member fits in a stored position with the second aperture around a portion of the valve stem and the first and second end portions extending generally alongside the valve stem, such that the lever member is configured to be stored under the cover when the cover is secured over a valve stem of an aerosol container.

12. The lever of claim 11, wherein the second aperture is angled relative to the first end portion such that the lever member fits with the second aperture around the valve stem, with the first and second end portions at an angle of between 0 to 20 degrees relative to the axis of the valve stem.

13. The lever of claim 11, wherein the first aperture of the lever member is configured to be releasably received over a valve stem of an aerosol valve, such that the second end portion extending outwardly from the valve stem provides a lever displacement range that is at least 87 percent greater than the valve stem's displacement range.

14. The lever of claim 13 wherein the first aperture of the lever member is configured to be releasably received over a valve stem of an aerosol valve, such that the force required to displace the second end portion for initiating dispensing operation is at least 47 percent less than the force required to displace the valve stem for initiating dispensing operation.

15. The lever of claim 11, wherein the lever member is configured to be releasably received over a valve stem of an aerosol valve, such that the second end portion extending outwardly from the valve stem may be depressed by a user instead of the valve stem, to thereby reduce risk of contact with and contamination of food product dispensed from the valve stem.

16. The lever of claim 11, wherein the second aperture provides a reduced cross-sectional area within the lever member relative to the cross-sectional area of the second end portion, which causes greater deflection when the second end portion is depressed, to thereby provide for increased lever displacement for improving control over flow rate of product being dispensed.

17. The lever of claim 11, wherein the lever member further includes a slot extending between the first and second apertures, such that the lever member may be slid from the stored position to the dispensing position without removing the lever member from the valve stem.

18. The lever of claim 11, wherein the lever member further includes at least one protrusion or retaining member that is configured to be received within an opening or recess in the cover, to releasably retain the lever member 102 within the interior of the cover.

19. The lever of claim 18 wherein the lever member includes a projection that is configured to engage an opening in the cover to retain the lever member within the cover until the cover in which the lever member is releasably retained is secured to the aerosol container, upon which engagement of the lever with the aerosol container causes the projection on the lever member to dislodge from the cover such that the lever member is not retained to the cover upon subsequent removal of the cover.

20. A lever in combination with a cover for an aerosol valve having a valve stem, comprising:

a cover configured to be secured over a valve stem of an aerosol container, the cover having a retaining member disposed within the interior of the cover; and a lever member having a retaining member engaging the retaining member of the cover to releasably retain the lever member within the cover, the lever member having first and second end portions, a first aperture disposed in the first end portion, and a second aperture disposed between the first and second end portions, the first aperture being configured to permit the lever member to be releasably received over a valve stem of an aerosol valve in a dispensing position, and the second aperture being configured so that the lever member fits in a stored position with the second aperture around a portion of the valve stem and the first and second end portions extending generally alongside the valve stem, such that the lever member may be stored under the cover when the cover is secured over a valve stem of an aerosol container, wherein the lever further includes a projection thereon that is configured to engage an aerosol container when the cover in which the lever is releasably retained is secured to the aerosol container, where said engagement causes the retaining member of the lever to dislodge from the cover such that the lever member is not retained to the cover upon subsequent removal of the cover.

* * * * *